US006755462B2

(12) United States Patent
Zheng

(10) Patent No.: US 6,755,462 B2
(45) Date of Patent: Jun. 29, 2004

(54) CUSHIONED SEAT AND BACK SUPPORT FOR COLLAPSIBLE CHAIR

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 54 days.

(21) Appl. No.: 09/966,872

(22) Filed: Sep. 27, 2001

(65) Prior Publication Data

US 2003/0057741 A1 Mar. 27, 2003

(51) Int. Cl.[7] ..... A47C 4/48
(52) U.S. Cl. ..... 297/16.2; 297/45
(58) Field of Search ..... 297/16.1, 16.2, 297/45, 219.1, 35, 228.1, 452.48

(56) References Cited

U.S. PATENT DOCUMENTS 1,602,115 A * 10/1926 Malis ..... 5/114
2,231,993 A * 2/1941 Fischer ..... 5/111
3,602,548 A * 8/1971 Grams ..... 297/452.16
4,042,986 A * 8/1977 Goodman et al. ..... 5/500
4,514,869 A * 5/1985 Aoki et al. ..... 297/452.17
5,187,825 A * 2/1993 Tesch ..... 5/502
5,506,020 A * 4/1996 Haberkorn ..... 428/102
6,382,715 B1 * 5/2002 Tang ..... 297/16.2
6,382,729 B1 * 5/2002 Wu ..... 297/452.41
6,428,098 B1 * 8/2002 Allbaugh ..... 297/219.12

* cited by examiner

*Primary Examiner*—Peter R. Brown
(74) *Attorney, Agent, or Firm*—Raymond Y. Chan; David and Raymond Patent Group

(57) ABSTRACT

The cushioned seat and back support, which is adapted for mounting on a chair frame of a collapsible chair, includes a support layer, a cover layer overlapped with the support layer, and a cushion layer sandwiched between the support layer and the cover layer, wherein the back support portion of the support layer is mounted to back frame legs of the foldable chair frame and the seat support portion of the support layer is supported by two front upper frame joints of the foldable chair frame, so as to substantially mount the cushioned seat and back support on the foldable chair frame.

3 Claims, 7 Drawing Sheets

CUSHIONED SEAT AND BACK SUPPORT FOR COLLAPSIBLE CHAIR

BACKGROUND OF THE PRESENT INVENTION

1. Field of Invention

The present invention relates to a collapsible chair, and more particularly to a cushioned seat and back support for collapsible chair, which increases the softness of the seat fabric, so as to render the collapsible chair to be used as indoor furniture with a comfort feeling, especially in the winter season.

2. Description of Related Arts

A conventional collapsible chair comprises a foldable chair frame constructed by metal tubes and a seat fabric. The foldable chair frame comprises a plurality of construction tubes to construct a back frame and a seat frame for supporting the fabric seat. The seat frame comprises a front pair, a back pair, and two side pairs of the construction tubes, wherein each pair of the construction tubes are pivotally connected together where they cross so that the foldable chair frame can be easily unfolded to provide a rigid cross-support for use and be folded up for storage.

The fabric seat of the conventional collapsible chair is preferably made of durable fabric, such as twilled nylon or other mixing material such as polyurethane. It is well known that the conventional collapsible chair is uncomfortable. It is because the fabric seat is the only support for the entire weight of the user so that it must be durable and strong enough to tolerate and support the downward pulling force of the user's weight to retain the shape of the foldable chair.

Because the conventional collapsible chair can be quickly and easily unfolded for use and folded into a compact fold-up structure for carriage, the user can carry the collapsible chair for all kinds of outdoor activity, such as using on campground or beach. However, the uncomfortable collapsible chair will be only limited to purposely use for the outdoor activities and is considered as outdoor furniture. Therefore, the rough feeling the fabric seat of the collapsible chair is merely suitable for temporary use and thus one wants to use it as indoor furniture. In other words, when the collapsible chair is not use, the user may merely fold-up the collapsible hair and store it in the trunk of a vehicle or somewhere indoor until the user has some outdoor activities occasionally. Moreover, the conventional collapsible chair is not so suitable for winter use because the nylon material of its fabric seat does not accumulate heat that the user has to tolerate the cold feel. Even though the body temperature of the user may warm up the upper contacting surface of the fabric seat, the bottom surface conducts the body heat to the cold environment thereunder immediately.

SUMMARY OF THE PRESENT INVENTION

A main object of the present invention is to provide a cushioned seat and back support for collapsible chair, which increases the softness of the fabric seat, so as to render the collapsible chair to be used as indoor furniture with a comfort feeling, especially in the winter season.

Another object of the present invention is to provide a cushioned seat and back support for collapsible chair, which can also be quickly and easily folded into a compact unit for carriage and storage and unfolded for use.

Another object of the present invention is to provide a cushioned seat and back support for collapsible chair, wherein the fabric seat comprises a durable support layer for substantially supporting the downward pulling force of the user's weight and a cushion layer for providing a softness of the fabric seat. Therefore, the collapsible chair of the present invention is specifically designed for using in both indoor and outdoor conditions.

Another object of the present invention is to provide a cushioned seat and support for collapsible chair, wherein the fabric seat has a plurality of partitions for holding the cushion layers in position, so as to retain the shape of the cushion layer of the fabric seat.

Another object of the present invention is to provide a cushioned seat and back support for collapsible chair, which does not requires altering the original structural design of the conventional collapsible chair, so as to maintain the durability of the conventional collapsible chair.

Another object of the present invention is to provide a cushioned seat and back support for collapsible chair, wherein the cushioned seat and back support is capable of detachably mounting on the durable support so as to fit different types of usage.

Accordingly, in order to accomplish the above objects, the present invention provides a cushioned seat and back support for collapsible chair, which comprises a foldable chair frame constructed to support a cushioned seat and back support thereon. The foldable chair frame comprises a pair of back frame legs, a pair of front frame legs pivotally connected in cross manner, two pair of side frame legs wherein each pair of which comprises a first side frame leg and a second side frame leg pivotally connected in cross manner, and two front upper frame joints for pivotally connecting two upper ends of the two first side frame legs respectively.

The cushioned seat and back support, which has a back support portion and a seat support portion, comprises a support layer, a cover layer overlapped with the support layer, and a cushion layer sandwiched between the support layer and the cover layer, wherein the back support portion of the support layer is mounted to the back frame legs and the seat support portion of the support layer is supported by the front upper frame joints, so as to substantially mount the cushioned seat and back support on the foldable chair frame.

DETAILED DESCRIPTION OF THE PREFERRED EMBODIMENT

Figure 1:
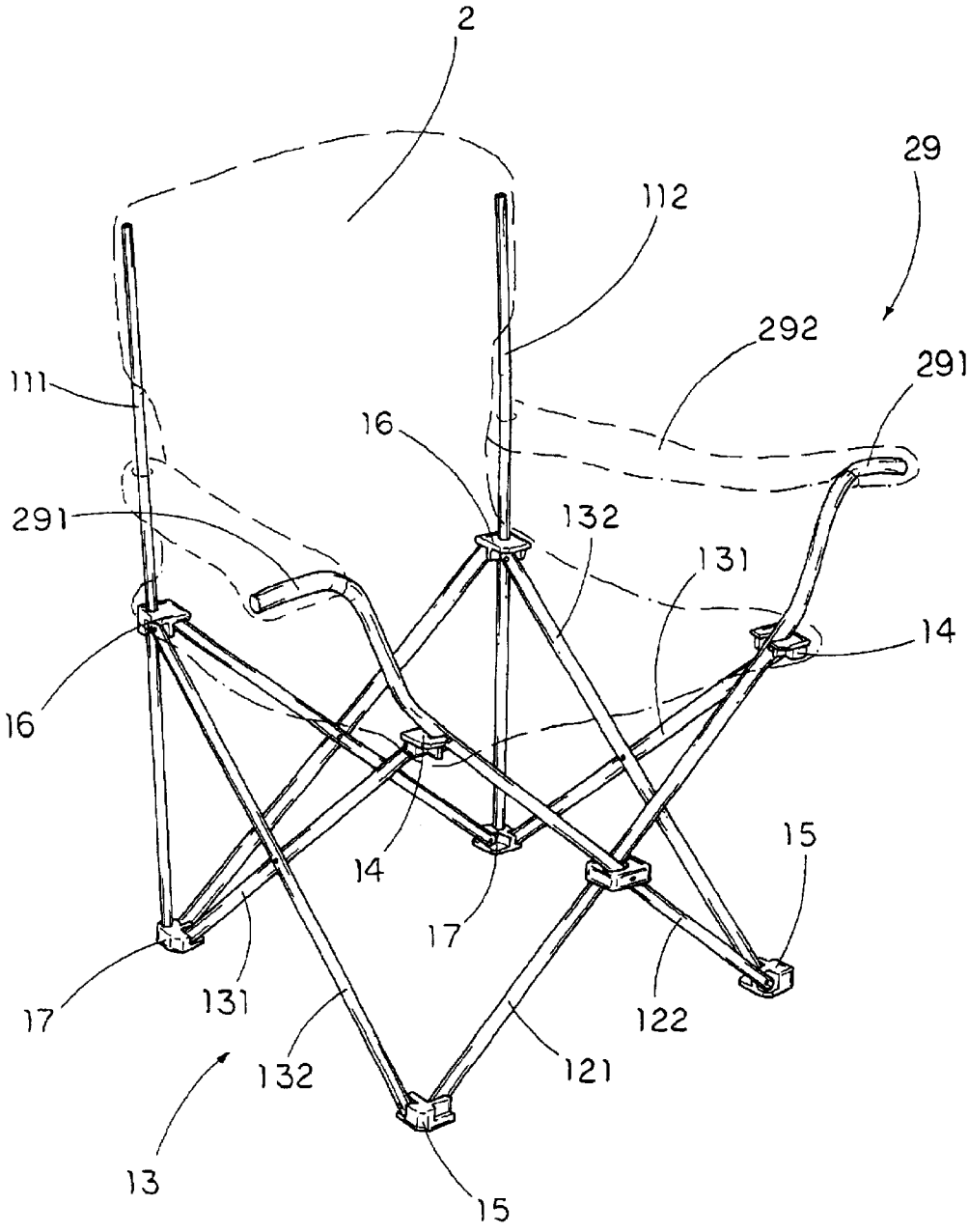
FIG. 1 is a perspective view of a collapsible chair employed with a cushioned seat and back support according to a preferred embodiment of the present invention.

Referring to FIG. 1 of the drawings, a collapsible chair 1 employed with a cushioned seat and back support 2 according to a preferred embodiment of the present invention is illustrated, wherein the collapsible chair 1 comprises a foldable chair frame 10 constructed to support a cushioned seat and back support 2 thereon.

The foldable chair frame 10, such as all kinds of conventional chair frame, comprises a pair of back frame legs 111, 112, a pair of front frame legs 121, 122 pivotally connected in cross manner, two pair of side frame legs 13 wherein each pair of which comprises a first side frame leg 131 and a second side frame leg 132 pivotally connected in cross manner, and two front upper frame joints 14 for pivotally connecting two upper ends of the two first side frame legs 131 respectively.

The bottom ends of the two second side frame legs 132 are pivotally connected to a pair of front bottom joints 15 respective while the upper ends of the two second side frame legs 132 are extended backwardly and upwardly to respectively pivotally connected to a pair of back upper frame joints 16 that are slidably mounted on the two back frame legs 111, 112. The bottom ends of the two first side frame legs 131 are pivotally and respectively connected to a pair of back bottom frame joints 17 that are mounted on the bottom ends of the two back frame legs 111, 112 respectively.

Figure 2:
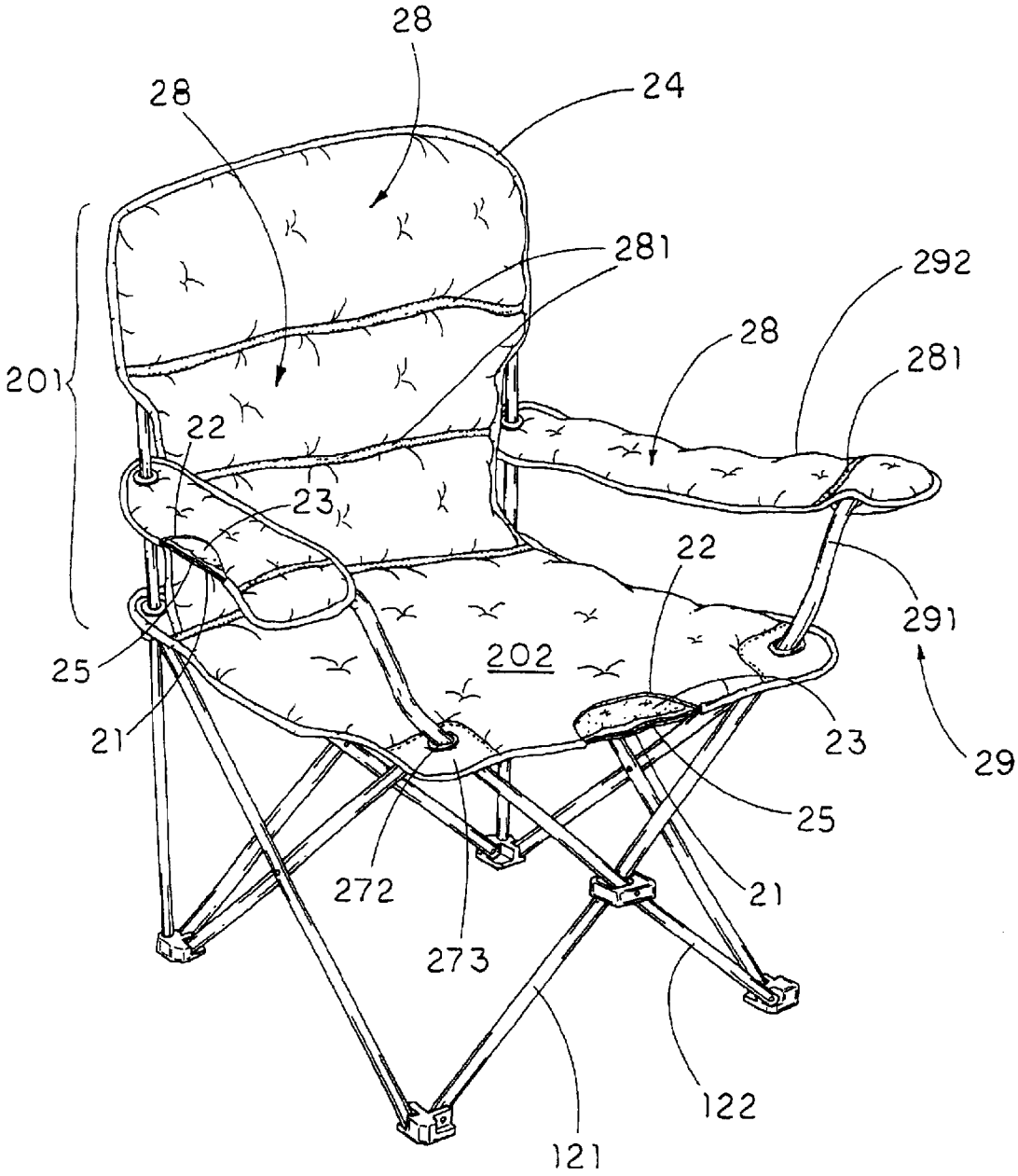
FIG. 2 is a perspective view of the cushioned seat and back support for collapsible chair according to the above preferred embodiment of the present invention.
Figure 3:
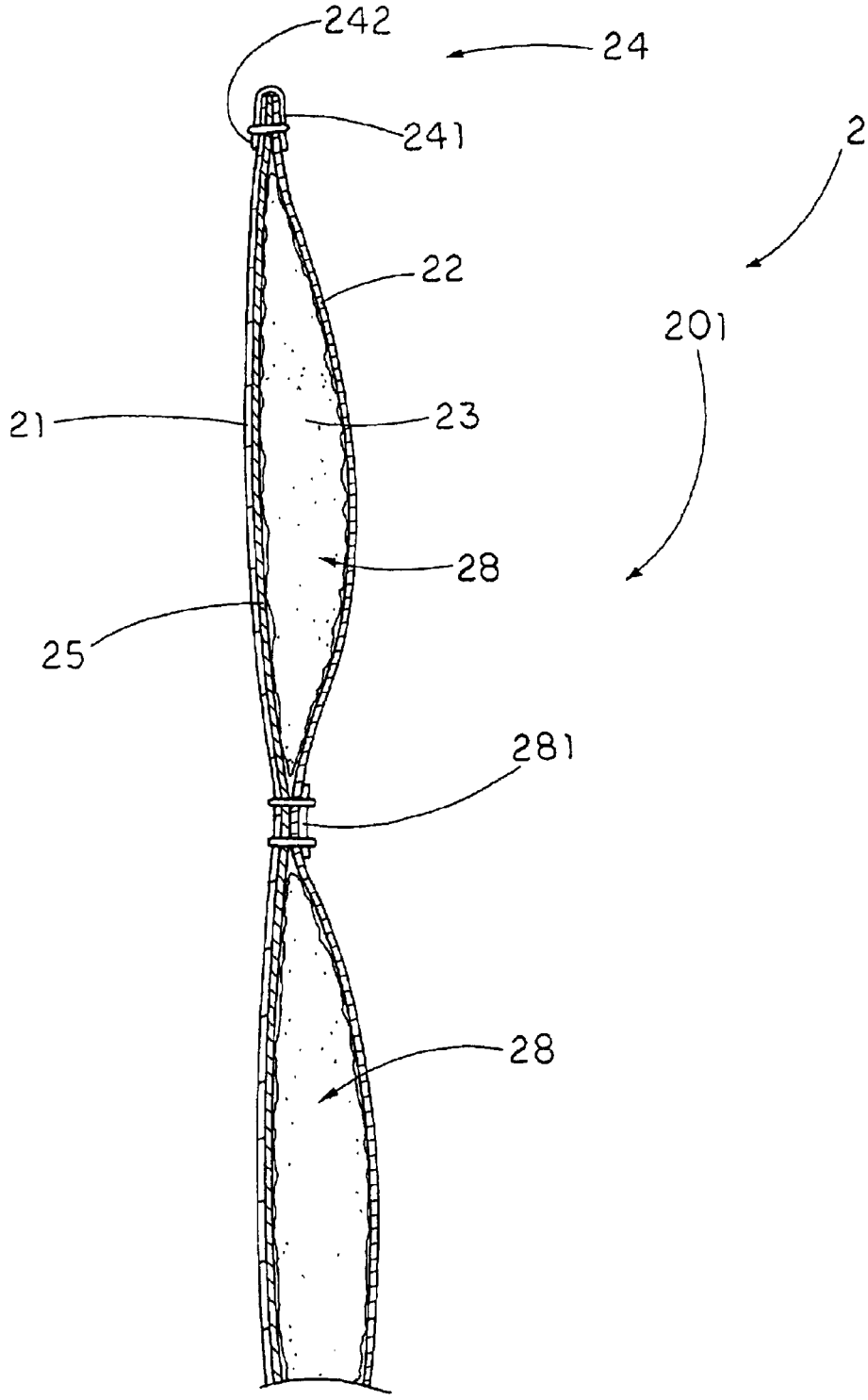
FIG. 3 is a sectional view of the cushioned seat and back support for collapsible chair according to the above preferred embodiment of the present invention.

As shown in FIGS. 2 and 3, the cushioned seat and back support 2 has a back support portion 201 and a seat support portion 202. The cushioned seat and back support 2 comprises a support layer 21, a cover layer 22 overlapped with the support layer 21, and a cushion layer 23 sandwiched between the support layer 21 and the cover layer 22, wherein the back support portion 201 of the support layer 21 is mounted to the back frame legs 111, 112 and the seat support portion 202 of the support layer 21 is supported by the front upper frame joints 14, 15, so as to substantially mount the cushioned seat and back support 2 on the foldable chair frame 10.

The support layer 21 is made of lightweight but durable material such as twilled nylon or other mixing material such as polyurethane that can substantially support a downward pulling force of the user's weight.

The cover layer 22 should be non-irritant and comfort and preferred to be made of heat insulating material such as cotton, woolen or felt, so as to provide a soft and warm surface in contact with the user's body. According to the preferred embodiment, the cover layer 22, having the same shape and size of the support layer 21, is overlappedly bonded to the support layer 22 edge to edge wherein the cushion layer 23 is evenly received between the support layer 21 and the cover layer 22.

The cushion layer 23 is made of heat insulating material, such as cotton or synthetic cotton, to softly and comfortably support the user rested thereon. The cushion layer 23 is preferred to be overlappedly bonded to the cover layer 22 by applying an adhesive substance on the cover layer 22 so as to retain the cushion layer 23 on the cover layer 22 in position.

The cushioned seat and back support 2 further comprises at least an elongated edge protection strap 24 which has a U-shaped cross section longitudinally defining a first leaf 241 and a second leaf 242 and extended along surrounding edges of the cushioned seat and back support 2 to sandwich the surrounding edges of the cushioned seat and back support 2 between the first leaf 241 and the second leaf 242 of the edge protection strap 24, as shown in FIG. 2. In other words, edges of the support layer 21 and the cover layer 22 are enclosed by the edge protection strap 24 wherein the first leaf 241, the edges of the support layer 21 and the cover layer 22, and the second leaf 242 are integrally connected together by stitching. Therefore, the support layer 21 and the cover layer 22 are firmly attached together along the surrounding edges thereof to form the cushioned seat and back support 2 in such a manner that the cushion layer 23 is retained between the support layer 21 and the cover layer 22 in position.

In order to hold the cushion layer 23 in position, the cushioned seat and back support 2 further has at least two partitions 28 provided on the back support portion 201 of the cushioned seat and back support 2 wherein the partitions 28 are formed by an elongated positioning strap 281 transversely attached to the back support portion 201 by stitching through the cover sheet 22 to the support layer 21 such that the elongated positioning strap 281 is formed between the two partitions 28. It is worth to mention that each partition 28 has a predetermined volume for enclosing the cushion layer 23 therein so as to prevent the cushion layer 23 from sagging over a period of continued use. Alternatively, the partitions 28 can be formed by transversely and directly stitching on the back support portion 201.

As shown in FIG. 2, there are four partitions 28 are formed on the cushioned seat and back support 2, wherein three partitions 28 are formed on the vertically supported back support portion 201 and one partition 28 is formed on the seat support portion 202. In other words, two elongated positioning straps 281 are transversely attached to the back support portion 201 to define the three partitions 28 and one elongated positioning straps 281 is transversely attached between the back support portion 201 and the seat support portion 202 to define the partition 28 on the seat support portion 202.

The cushion seat and back support 2 further comprises an inner layer 25 provided between the cushion layer 23 and the support layer 21 wherein the inner layer 25 has a size and shape equal to the support layer 21 so as to strengthen and support the support layer 21. In other words, the cushion layer 23 is sandwiched between the inner layer 25 and the cover layer 22. Accordingly, the inner layer 25 is overlappedly bonded to the support layer 21 wherein edges of the inner layer 25 is enclosed between the first leaf 241 and the second leaf 242 of the edge protection strap 24 so as to firmly attach the inner layer 25 between the support layer 21 and the cover layer 22.

Figure 4:
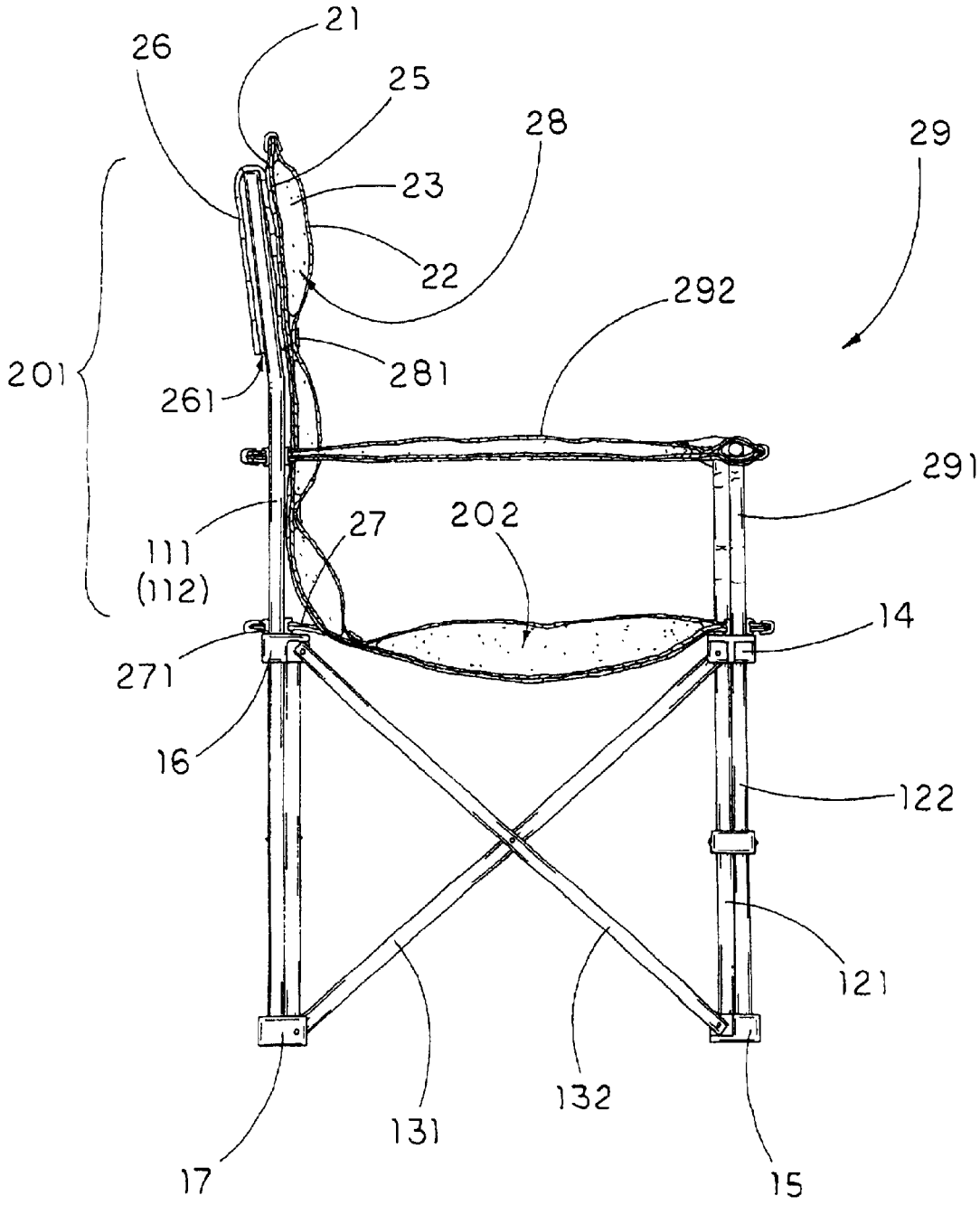
FIG. 4 is a side view of the cushioned seat and back support mounted on the collapsible chair according to the above preferred embodiment of the present invention.

The back support portion 201 of the cushioned seat and back support 2 can be fastened or tighten to the back frame legs 111, 112, as shown in FIG. 4. According to the preferred embodiment as shown in FIG. 3, two side pockets 26 are provided at two upper corners of the rear surface of the back support portion 201 of the support layer 21 respectively. Each of the side pockets 26 has a top closed end and a bottom opened end to define a tubular pocket cavity 261 therein for fittedly receiving an upper end portion of the respective back frame leg 111, 112. In order to further hold the back support portion 201 to the back frame legs 111, 112, two screwed can be used to fasten the two side pockets 26 to the two back frame legs 111, 112 respectively. In other words, the attachment of the cushioned seat and back support 2 with the foldable chair frame 10 is easy and fast, that is simply by inserting two upper end portions of the back frame legs 111, 112 into the two side pockets 26 provided on two upper corners of the rear surface of the back support portion 201 of the support layer 21.

As shown in FIG. 2, the cushioned seat and back support 2 further comprises a reinforcing flap 27 rearwardly extended from the seat support portion 202 toward the two back upper frame joints 16 wherein the reinforcing flap 27 has two leg placement rings 271 provided at two rear corners thereof respectively for the two back frame legs 111, 112 to penetrate therethrough respectively, so as to enable the two leg replacement rings 271 and the reinforcing flap 27 resting on the two back upper frame joints 16 for additionally supporting the seat support portion 202 of the cushioned seat and back support 2 and distributing the downward pulling force applied by the user's weight on the cushioned seat and back support 2. Therefore, the cushioned seat and back support 2 can be well supported on the foldable chair frame 10.

Figure 5:
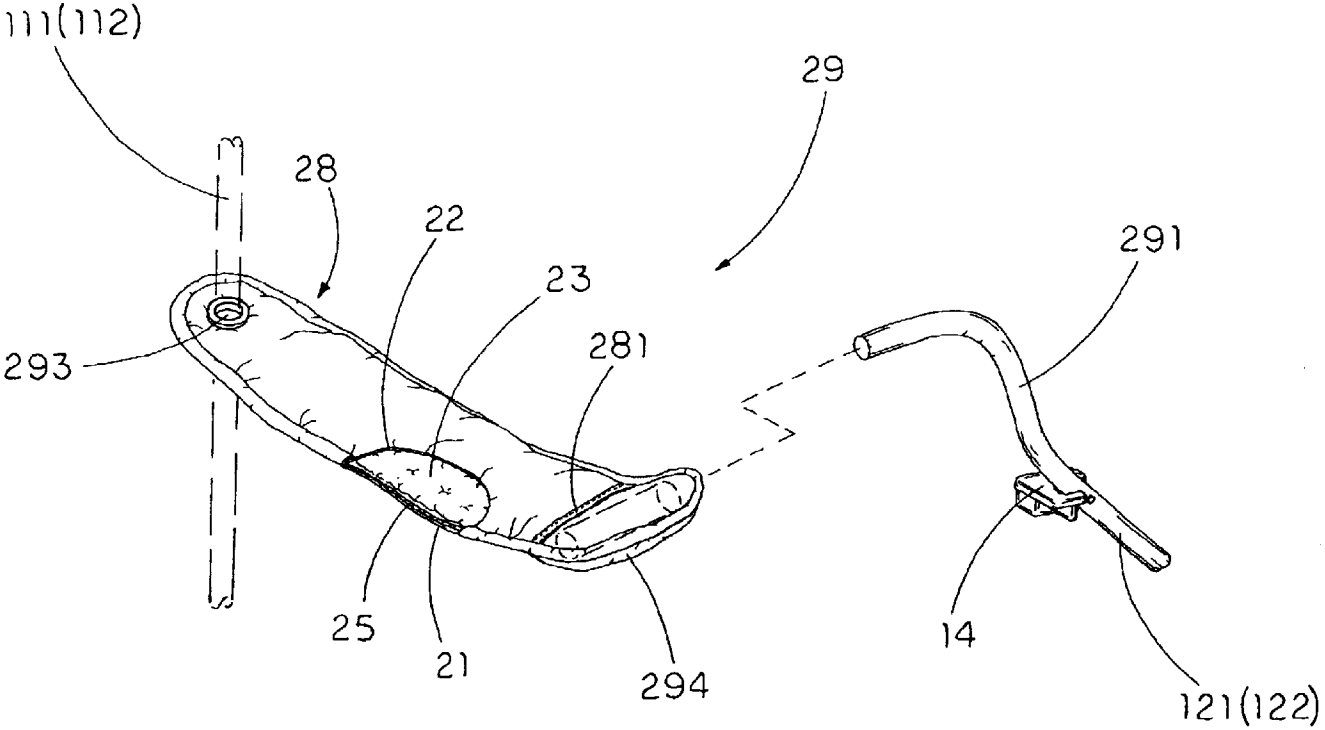
FIG. 5 is a perspective view of an arm support of the cushioned seat and back support for collapsible chair according to the above preferred embodiment of the present invention.

As shown in FIG. 5, the collapsible chair 1 further comprises a pair of arm rest arrangements 29 for supporting the user's arms thereon wherein arm rest arrangement 29 comprises a pair of supporting arms 291 upwardly extended from the two front upper frame joints 14 of the foldable chair frame 10 respectively and a pair of fabric arm supports 292 extended between the back frame legs 111, 112 and the supporting arms 291 respectively so as to substantially provide an arm rest area of the collapsible chair 1.

Accordingly, the two supporting arms 291 are two upper end portions of the two front frame legs 121, 122 respectively. Each of the two front frame legs 121, 122 has a length longer than a distance between the respective front bottom frame joint 15 and the respective front upper frame joint 14 so that the two supporting arms 291, i.e. the two upper portions of the front frame legs 121, 122, extended through the two front upper frame joints 14 respectively.

In order to provide a better support for the user's arms, each of the arm rest arrangement 29 further comprises a mounting ring 293 provided on a rear end portion of the fabric arm supports 292 for the respective back frame leg 111, 112 to slidably penetrate therethrough, and a tubular holding pocket 294 transversely provided on a front end of a bottom surface of the fabric arm supports 292 for the upper end of the respective supporting arm 291 fittedly inserted thereinto. Accordingly, each upper end of the supporting arm 291 is bent to a horizontal position to provide a horizontal arm rest area so as to better and more comfortably support the user's arm on the fabric arm support 292.

Each of the fabric arm supports 292 is basically constructed as the same as the cushioned seat and back support 2, which comprises the support layer 21, the cover layer 22, the cushion layer 23, and the inner layer 25 as mentioned above. Besides, the partition 28 is also formed on each of the fabric arm supports 292 by attaching the positioning straps 281 on the cover layer 22 of the fabric arm support 292 adjacent to the tubular holding pocket 294, so as to prevent the cushion layer 23 of the fabric arm support 292 from being sagging over a period of continued use.

Moreover, for attaching the seat support portion 202 of the cushioned seat and back support 2 to the foldable chair frame 10, two front corners of the seat support portion 202 of the cushioned seat and back support 2 provide with two positioning rings 272 respectively for the two supporting arms 291 to penetrate therethrough respectively so as to enable the two positioning rings 272 and the seat support portion 202 resting on the two front upper joints 14. Since the two front frame legs 121, 122 are inclinedly penetrating through the two front upper frame joints 14 to form the two supporting arms 291 respectively, the positioning rings 272 are preferred to be made in oval shape to fit the cross sectional shape of the inclined front frame legs 121, 122. Thus, two reinforcing pad 273 are attached to the two front corners of the cover layer 22 for strengthening the cover layer 22 so as to prevent the cushioned seat and back support 2 from being torn off by the stress around the positioning rings 272.

Figure 6:
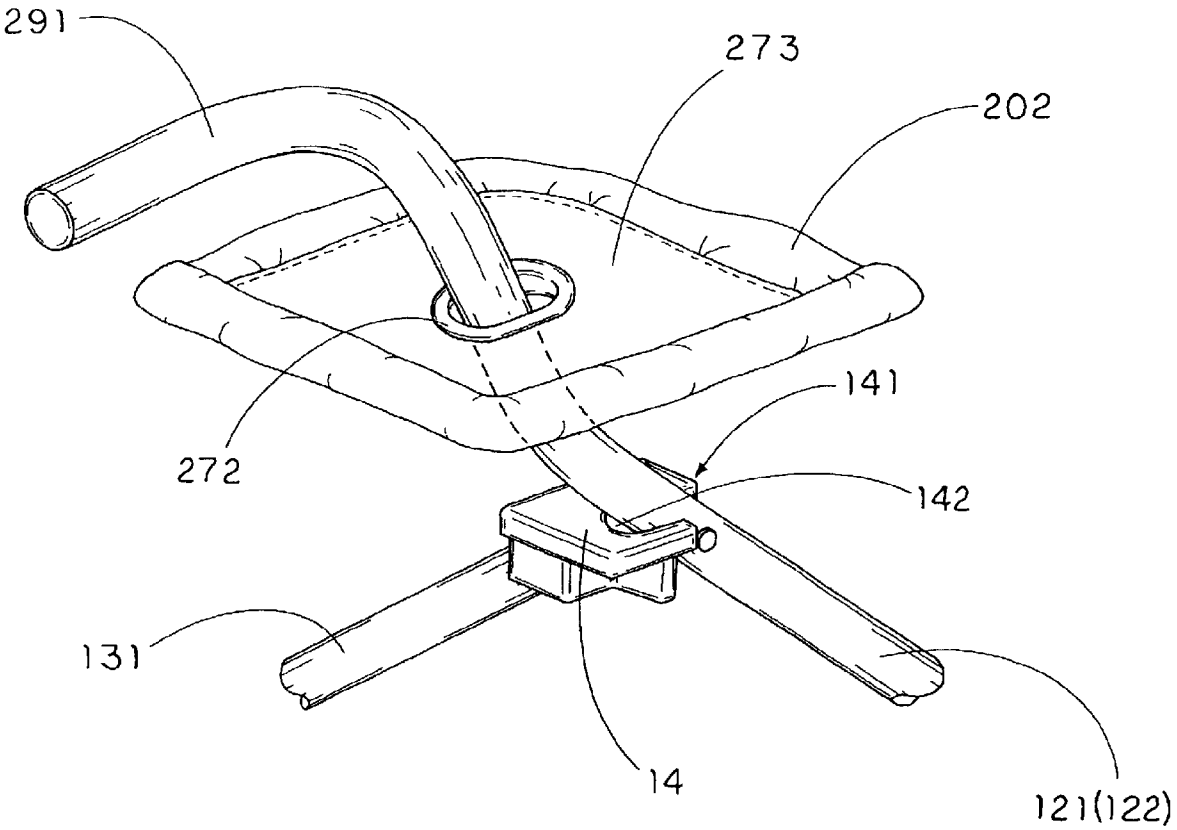
FIG. 6 is a perspective view of a front upper frame joint of the collapsible chair according to the above preferred embodiment of the present invention.

Referring to FIG. 6, in order to well support the two front frame legs 121, 122 and construct the foldable chair frame 10, the two front upper frame joints 14 are specifically constructed to each have a through hole support slot 141 for the upper ends of the two front frame legs 121, 122 to penetrate through upwardly and sidewardly to form the two supporting arms 291 respectively. Moreover, an inclined resting surface 142 is provided within the support slot 141 so that when the respective front frame leg 121, 122 is pivotally connected to the front upper frame joint 14 with a rivet 143, as shown in FIG. 6, the inclined resting surface 142 can substantially and fittedly support the inclined front frame leg 121, 122.

Figure 7:
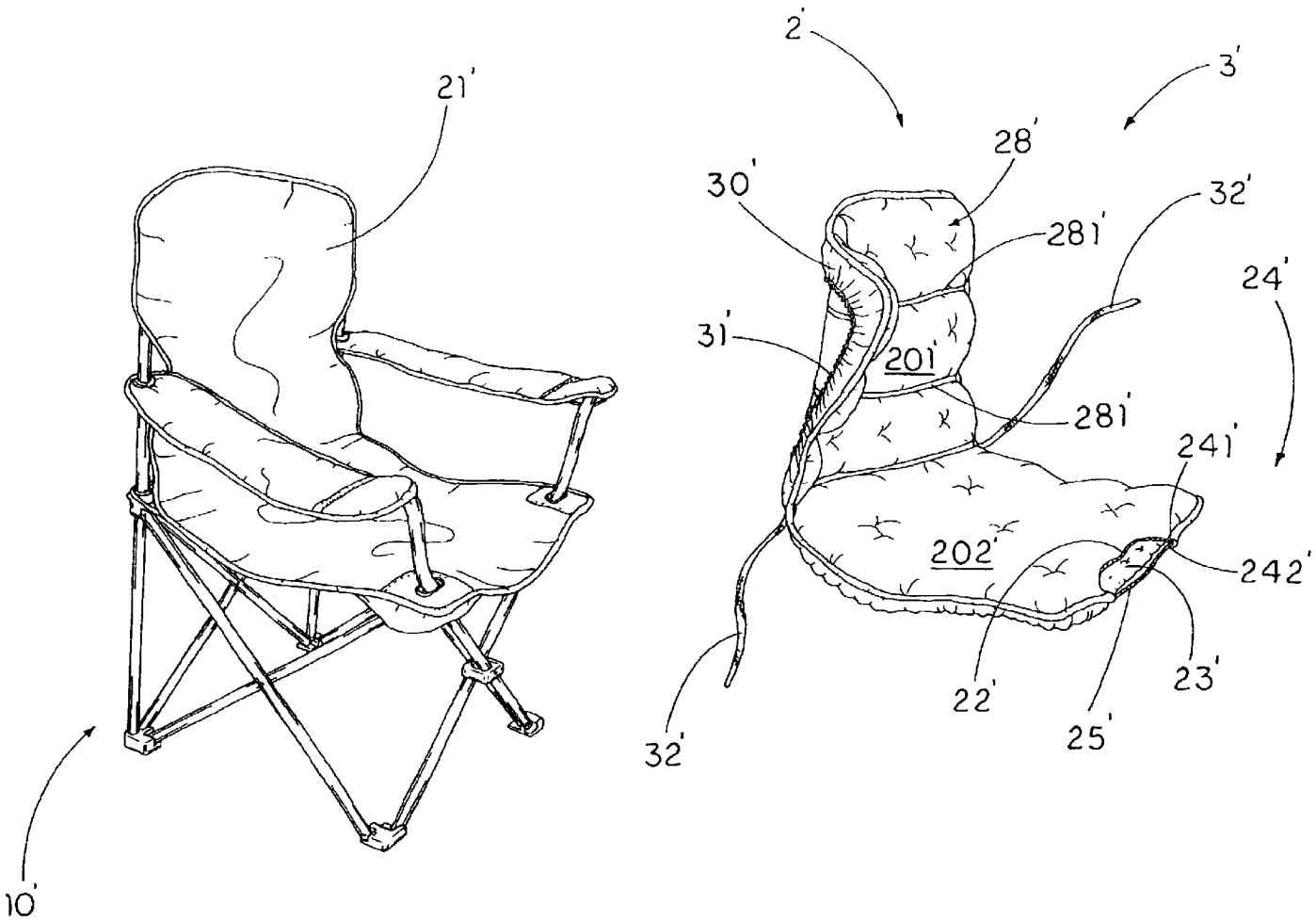
FIG. 7 illustrates an alternative mode of the cushioned seat and back support for collapsible chair according to the above preferred embodiment of the present invention.

FIG. 7 illustrates an alternative mode of the cushioned seat and back support 2' which also has the back support portion 201' and the seat support portion 202' mounted on the foldable chair frame 10, wherein the cushion layer 23' is overlappedly bonded between the inner layer 25' and the cover layer 22' while the edge protection strap 24' is encirclingly attached along the surrounding edges of the inner layer 25' and the cover layer 22' to form a seat cover 3'. The difference of the cushioned seat and back support 2' is that the seat cover 3' can be detachably mounted on the support layer 21' by detachably mounting the inner layer 25' on the support layer 21' which is permanently mounted on the foldable chair frame 10. Thus, at least two partitions 28' are provided on the back support portion 201' of the seat cover 3' wherein the partitions are formed by an elongated positioning strap 281' transversely attached to the back support portion 201' by stitching through the cover sheet 21' to the inner layer 25' such that the elongated positioning strap 281' is formed between the two partitions 28'.

As shown in FIG. 7, the seat cover 3' further comprises two edge holding flaps 30' overlappedly extended from surrounding edges thereof at the back support portion 201' and the seat support portion 202' respectively wherein the seat cover 3' is adapted for detachably mounting on the support layer 21' by flipping over the edge holding flaps 30' at the rear side of the support layer 21' so as to mount the inner layer 25' on the support layer 21' in position.

In order to enhance the detachably attachment between the seat cover 3' and the support layer 21', an elongated resilient element 31' which is a rubber band is affixed on edges of the edge holding flaps 30' to hold the support layer 21' in a tight manner. Thus, a pair of holding straps 32' are extended from two opposing sides of the seat cover 3' respectively and adapted for tightening with each other at the rear side of the support layer 21' so as to securely mount the seat cover 3' on the support layer 21'.

It is worth to mention that the user is able to selectively sit on the support layer 21' as a conventional collapsible chair and the cover layer 22' to provide a softy and comfortably support of the collapsible chair. In other words, the collapsible chair can be considered as both an outdoor and indoor furniture for the user and can be quickly and easily folded into a compact unit for carriage and storage and unfolded for use. Thus, the seat cover 3' should be launderability such that the user is able to clean the cushioned seat and back support 2' easily.

What is claimed is:

1. A collapsible chair, comprising:

a foldable chair frame constructed to support a cushioned seat and back support thereon, said foldable chair frame comprising a pair of back frame legs, a pair of front frame legs pivotally connected in cross manner, two pair of side frame legs wherein each pair of which comprises a first side frame leg and a second side frame leg pivotally connected in cross manner, and two front upper frame joints for pivotally connecting two upper ends of said two first side frame legs respectively, wherein said cushioned seat and back support, which has a back support portion and a seat support portion, comprises a support layer, a cover layer overlapped with said support layer, and a cushion layer sandwiched between said support layer and said cover layer, wherein said back support portion of said support layer is mounted to said back frame legs and said seat support portion of said support layer is supported by said front upper frame joints, so as to substantially mount said cushioned seat and back support on said foldable chair frame; and a pair of arm rest arrangements which comprises a pair of supporting arms upwardly extended from said two front upper frame joints of said foldable chair frame respectively and a pair of fabric arm supports extended between said back frame legs and said supporting arms respectively so as to substantially provide an arm rest area of said collapsible chair, wherein each of said fabric arm supports also comprises a support layer, a cover layer, a cushion layer, and an inner layer, wherein said cushion layer is sandwiched between said support layer and said cover layer and overlappedly bonded to said cover layer, wherein said inner layer which is provided between said cushion layer and said support layer is overlappedly bonded to said support layer so as to strengthen and support said support layer.

2. A collapsible chair, comprising;

a foldable chair frame constructed to support a cushioned seat and back support thereon, said foldable chair frame comprising a pair of back frame legs, a pair of front frame legs pivotally connected in cross manner, two pair of side frame legs wherein each pair of which comprises a first side frame leg and a second side frame leg pivotally connected in cross manner, and two front upper frame joints for pivotally connecting two upper ends of said two first side frame legs respectively, wherein said cushioned seat and back support, which has a back support portion and a seat support portion, comprises a support layer, a cover layer overlapped with said support layer, and a cushion layer sandwiched between said support layer and said cover layer, wherein said back support portion of said support layer is mounted to said back frame legs and said seat support portion of said support layer is supported by said front upper frame joints, so as to substantially mount said cushioned seat and back support on said foldable chair frame, wherein said cushioned seat and back support further comprises at least an elongated edge protection strap having a U-shaped cross section longitudinally defining a first leaf and a second leaf and extended along surrounding edges of said cushioned seat and back support to sandwich said surrounding edges of said support layer and said cover layer between said first leaf and said second leaf of said edge protection strap, wherein said cushion layer is overlappedly bonded to said cover layer; and a pair of arm rest arrangements which comprises a pair of supporting arms upwardly extended from said two front upper frame joints of said foldable chair frame respectively and a pair of fabric arm supports extended between said back frame legs and said supporting arms respectively so as to substantially provide an arm rest area of said collapsible chair, wherein each of said fabric arm supports also comprises a support layer, a cover layer, a cushion layer, and an inner layer, wherein said cushion layer is sandwiched between said support layer and said cover layer and overlappedly bonded to said cover layer, wherein said inner layer which is provided between said cushion layer and said support layer is overlappedly bonded to said support layer so as to strengthen and support said support layer.

3. A collapsible chair, comprising:

a foldable chair frame constructed to support a cushioned seat and back support thereon, said foldable chair frame comprising a pair of back frame legs, a pair of front frame legs pivotally connected in cross manner, two pair of side frame legs wherein each pair of which comprises a first side frame leg and a second side frame leg pivotally connected in cross manner, and two front upper frame joints for pivotally connecting two upper ends of said two first side frame legs respectively, wherein said cushioned seat and back support, which has a back support portion and a seat support portion, comprises a support layer, a cover layer overlapped with said support layer, and a cushion layer sandwiched between said support layer and said cover layer, wherein said back support portion of said support layer is mounted to said back frame legs and said seat support portion of said support layer is supported by said front upper frame joints, so as to substantially mount said cushioned seat and back support on said foldable chair frame, wherein said cushioned seat and back support further comprises at least an elongated edge protection strap having a U-shaped cross section longitudinally defining a first leaf and a second leaf and extended along surrounding edges of said cushioned seat and back support to sandwich said surrounding edges of said support layer and said cover layer between said first leaf and said second leaf of said edge protection strap, wherein said cushion layer is overlappedly bonded to said cover layer, wherein said cushioned seat and back support further comprises an inner layer provided between said cushion layer and said support layer wherein said inner layer is overlappedly bonded to said support layer so as to strengthen and support said support layer, wherein said cushioned seat and back support further has at least two partitions provided on said back support portion of said cushioned seat and back support wherein said partitions are formed by an elongated positioning strap transversely attached to said back support portion by stitching through said cover sheet to said support layer such that said elongated positioning strap is formed between said two partitions; and a pair of arm rest arrangements which comprises a pair of supporting arms upwardly extended from said two front upper frame joints of said foldable chair frame respectively and a pair of fabric arm supports extended between said back frame legs and said supporting arms respectively so as to substantially provide an arm rest area of said collapsible chair, wherein each of said fabric arm supports also comprises a support layer, a cover layer, a cushion layer, and an inner layer, wherein said cushion layer is sandwiched between said support layer and said cover layer and overlappedly bonded to said cover layer, wherein said inner layer which is provided between said cushion layer and said support layer is overlappedly bonded to said support layer so as to strengthen and support said support layer.

* * * * *